United States Patent [19]

Ikawa et al.

[11] 4,096,002

[45] Jun. 20, 1978

[54] HIGH DUTY DUCTILE CAST IRON WITH SUPERPLASTICITY AND ITS HEAT TREATMENT METHODS

[75] Inventors: Katsuya Ikawa; Yuichi Tanaka, both of Muroran, Japan

[73] Assignee: Riken Piston Ring Industrial Co. Ltd., Nishishinbashi, Japan

[21] Appl. No.: 583,681

[22] Filed: Jun. 4, 1975

[30] Foreign Application Priority Data

Sep. 25, 1974 Japan ..... 49-110160

[51] Int. Cl.[2] ..... C21D 5/00

[52] U.S. Cl. ..... 148/138; 148/35; 148/139

[58] Field of Search ..... 148/138, 139, 35, 2

[56] References Cited

U.S. PATENT DOCUMENTS

| | | | |
|---|---|---|---|
| 2,796,373 | 6/1957 | Berg | 148/139 |
| 3,000,770 | 9/1961 | Wittmoser | 148/138 |
| 3,005,736 | 10/1961 | Peras | 148/138 |
| 3,013,911 | 12/1961 | Peras | 148/138 |
| 3,155,498 | 11/1964 | Jandras | 148/139 |
| 3,850,699 | 11/1974 | Gierek et al. | 148/139 |
| 3,860,457 | 1/1975 | Vourinen et al. | 148/35 |
| 3,893,873 | 7/1975 | Hanai | 148/35 |
| 3,951,697 | 4/1976 | Sherby et al. | 148/12 C |

*Primary Examiner*—W. Stallard

[57] ABSTRACT

A spheroidal graphite cast iron containing some carbide stabilizing elements to have the maximum strain rate sensitivity factor of more than 0.3 and having very refined grain matrix structure, so that having an improved toughness at room temperature and having a matrix which is composed of fine austenite and fine ferrite grains and superplastic properties at the temperature between the eutectoid transformation temperature range and 50° C higher than that temperature range; and the method of heat treatment to obtain the said spheroidal graphite cast iron.

9 Claims, 15 Drawing Figures

FIG. 2 (x400)
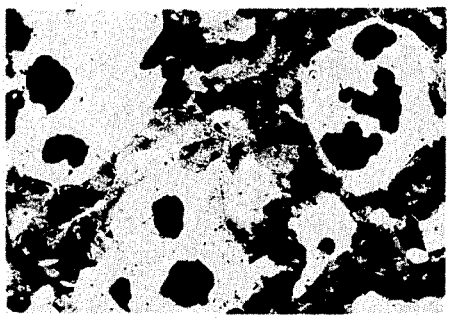
FIG. 5 (x400)
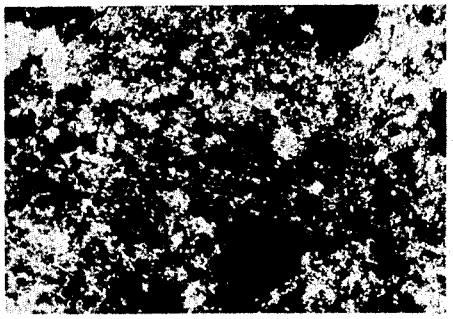
FIG. 3 (x400)
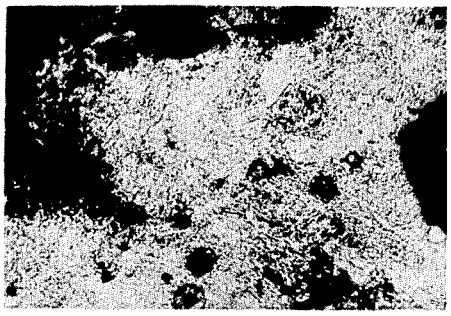
FIG. 6 (x400)
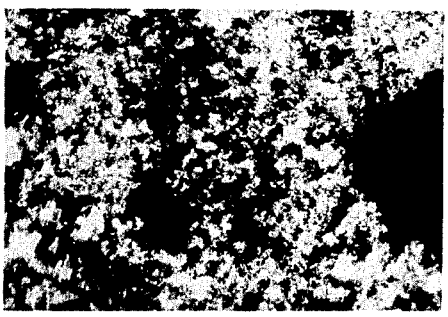
FIG. 4 (x400)
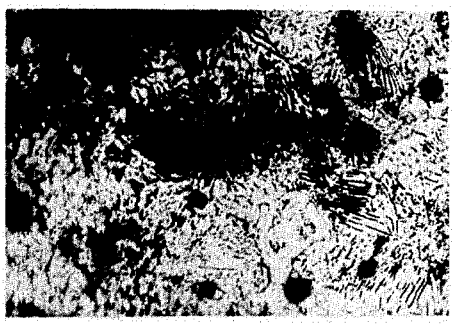
FIG. 7 (x400)
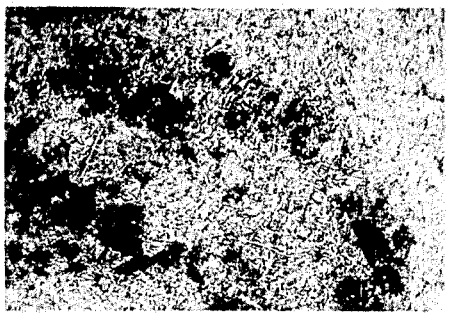

WHITE : GRAIN REFINED STRUCTURE
BLACK : STANDARD STRUCTURE

FIG.13 (x400)
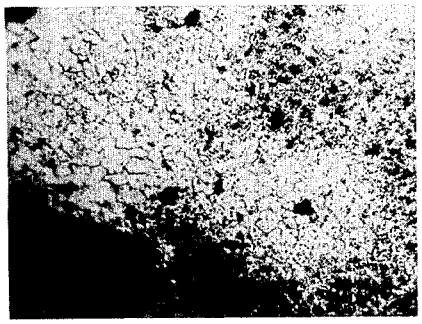
FIG.14 (x400)
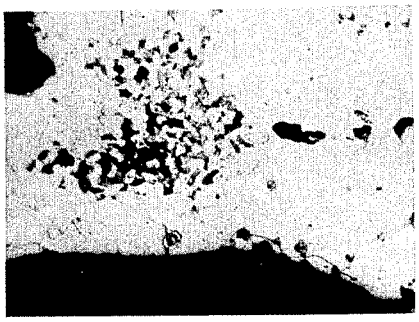
FIG.15 (x400)
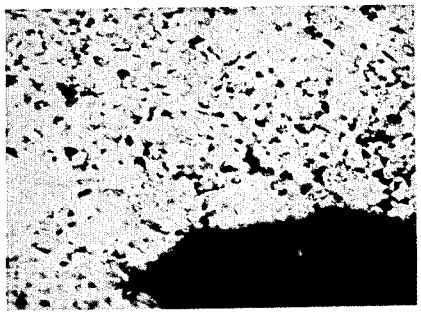

HIGH DUTY DUCTILE CAST IRON WITH SUPERPLASTICITY AND ITS HEAT TREATMENT METHODS

BACKGROUND OF THE INVENTION

The present invention relates to ductile cast iron which has an improved toughness and particularly superplasticity at the temperature ranging from the eutectoid temperature to about 50° C high above that temperature and so has a better plastic processing ability, and the methods of heat treatment to obtain the said iron.

Cast iron has made a remarkable progress by the invention of spheroidal graphite cast iron, i.e. ductile cast iron - thereafter will be called as s.g. iron -. However, it has not attained yet to the steel level in points of tensile ductility and impact strength, although to improve these properties of s.g. iron, several attempts such as graphite nodule refinement and the addition of special elements have been made. Further, these processes need some special melting process and have a disadvantage of using expensive raw materials.

In addition, cast iron has little use as material for the plastic processing because of its poor plasticity.

Therefore, if the plastic deformability could be improved without spoiling other good properties of cast iron, the use of s.g. iron may be extended more widely.

SUMMARY OF THE INVENTION

Accordingly, an object of the present invention is to provide a s.g. iron which has improved properties with respect to such defects as mentioned above, and another object is to provide suitable methods to obtain such a s.g. iron.

We have found that these and related objects may be attained in a s.g. iron having a structure comprising a grain refined matrix and the spheroidal graphites distributed in said matrix, said matrix being composed substantially of ferrite and fine cementite particles distributed in said ferrite, and containing enough emount of at least one of the carbide stabilizing elements to prevent graphitization. Thus, the fine cementite particles dissolve into ferrite with austenitization in situ, and the matrix becomes a structure composed of fine austenite and fine ferrite grains during heating to, and holding at, the temperature ranging from the eutectoid temperature to about 50° C above that temperature, and the maximum strain rate sensitivity factor of the material may be of more than 0.3 and the material may show a superplastic property at said temperature range.

The invention also includes heat treatment processes to make the matrix grain refined structure.

We have found that there are two kinds of heat treatment processes according to the type of material. The procedures are as follows:

(1) In case a martensitic structure is not formed in the matrix by air cooling from austenite temperature range.

The process comprises repeated cycles of rapid heating to the austenite temperature range followed by air cooling.

(2) In case a martensitic structure is formed in the matrix by air cooling from austenite temperature range. In this case, above process is not applicable and the process comprises successive steps of (i) heating to the austenite temperature range followed by air cooling, and (ii) tempering at the eutectoid temperature range.

The s.g. iron according to the present invention has an improved toughness due to its grain refined matrix structure, besides that, it has a better deformability due to its superplastic property so that the use as the material for mechanical processing such as forging and rolling may be developed widely other than usual use as castings, and such material may be obtained by a comparatively simple process, without need of any special and expensive elements.

It is known that when a metallic material with very fine grain structure is subjected to the plastic deformation, it behaves in different ways in many aspects from that of ordinary grain size.

For example, Zn—Al eutectoid alloy and Al—Cu eutectic alloy with the grain size of 2 or 3 microns show very large elongation values of several hundreds or thousands percent under low flow stresses without the necking.

In these cases, the main feature is that the grain refined structures are stable and maintained even at the higher testing temperature.

These phenomena are called isothermal superplasticity or ultrafine grain superplasticity — thereafter it will be called "superplasticity"—, and recognized in many non-ferrous alloys and pure metals.

For the ferrous material, it has been reported that the superplasticity appears at the eutectoid temperature range, when the low alloyed steels and the low manganese steels are deformed while cooling from the temperature above that temperature range.

By the way, it has also been reported that, in the tensile test, following relationship may exist between the flow stress $\sigma$ (Kg/mm$^2$) and the strain rate $d\epsilon/dt$.

$$\sigma = k\cdot(d\epsilon/dt)^m$$

In this equation, $k$ is a constant, and $m$ is variable with strain rate and temperature and is called "strain rate sensitivity factor of the flow stress"— thereafter, it will be called as "strain rate sensitivity factor"—.

As seen from the above equation, the greater the $m$-value becomes, flow stress $\sigma$ may decrease more rapidly with the decrease of strain rate $d\epsilon/dt$.

Also, from the investigation on the non-ferrous superplastic materials, it is recognized that the higher strain rate sensitivity factor corresponds to the larger elongation.

We have found also with the s.g. iron, which contains enough amount of carbide stabilizing elements and has a refined grain matrix, a high value of strain rate sensitivity factor $m$ of more than 0.3 is obtainable at the strain rate of $2 \times 10^{-3}$/min.

We have succeeded in obtaining such grain refined matrix structure by a heat treatment, and maintaining that structure at about its eutectoid temperature range by the addition of carbide stabilizing elements.

Further embodiments of the present invention will be described below in more details with reference to the accompanying figures, wherein:

FIG. 1 is a graph showing relation between the maximum strain rate sensitivity factor and the manganese content of s.g. iron, FIGS. 2, 3 and 4 are microphotographs showing standard structures of comparing material and s.g. irons according to this invention, respectively, FIGS. 5, 6 and 7 are microphotographs of grain refined structures of the material shown in FIGS. 2, 3 and 4, respectively, FIG. 8 is a graph showing relations between flow stress and strain rate at various temperatures, with the comparing material, FIGS. 9 and 10 are graphs similar to that shown in FIG. 8, but with the materials concerning to this invention, FIGS. 11 and 12 are graphs showing relations between the elongation and testing temperature with different strain rate values and materials, FIGS. 13, 14 and 15 are microphotographs showing structures near the fractures of the tested specimens after the constant strain rate high temperature tensile test, each with the comparing material and s.g. irons according to this invention, respectively.

DESCRIPTION OF THE PREFERRED EMBODIMENTS

Basic chemical composition of the s.g. iron according to this invention may be of the usual s.g. iron such as listed in Table 1, for example.

Table 1

| C | Si | Mn | P | S | Mg |
|---|---|---|---|---|---|
| | | (wt. %) | | | |
| 3.0~4.0 | 1.5~2.5 | <0.8 | <0.1 | <0.02 | 0.04~0.06 |

To such an iron, carbide stabilizing element, such as manganese or molybdenum, either has a moderate ability, is added to increase the maximum of strain rate sensitivity factor $m$ to more than 0.3.

For example, manganese content of 0.4 - 1.5% may be given by the graph as shown in FIG. 1, which is showing the relation between manganese content and maximum strain rate sensitivity factor $m$ obtained by our study at the strain rate of $2 \times 10^{-3}$/min.

The maximum strain rate sensitivity factor $m$ depends on the strain rate and temperature, and the $m$-value of more than 0.3 at the strain rate of $d\epsilon/dt = 2 \times 10^{-3}$/min. is desirable, because, if the $m$-value is less than 0.3, specimens may be fractured at an earlier stage of the tensile test by the necking due to local deformation, and the material may cause cracking in case of plastic deformation processing.

EXAMPLES

S.g. iron samples M03, M10 and M15 of common basic composition, but with different manganese contents as listed respectively in Table 2 were prepared by the ordinary melting process for s.g. iron.

Table 2

| Sample | Chemical Composition wt.% | | | | | | Eutectoid Temperature Range, ° C |
|---|---|---|---|---|---|---|---|
| | C | Si | Mn | P | S | Mg | |
| M03 | 3.35 | 1.82 | 0.28 | 0.023 | 0.008 | 0.044 | 749~793 |
| M10 | 3.08 | 1.84 | 0.92 | 0.024 | 0.009 | 0.036 | 738~758 |
| M15 | 3.20 | 1.95 | 1.42 | 0.022 | 0.009 | 0.049 | 690~706 |

Sample M03 is of ordinary composition but with low manganese content and used for comparison, and samples M10 and M15 are concerned to this invention and have a relatively high manganese content by adding the same particularly. Eutectoid transformation temperature ranges obtained by the dilatation measurements are also listed in Table 2 together.

These samples were annealed at the temperature of 900° - 950° C for 7 - 20 hrs. for the first stage graphitization, and further annealed at the temperature of 700° C for the second stage graphitization — ferritizing annealing —.

To obtain standard structure, samples M03 and M10 were normalized by heating at 850° C for 2 hrs. followed by air cooling.

Sample M15 was annealed for the same purpose for 16 hrs. at the temperature of 700° C, which is within the eutectoid temperature range, and then air cooled. FIGS. 2, 3 and 4 show the standard structure of each sample. FIG. 2 shows a bull's eye structure of sample M03, whereas, FIGS. 3 and 4 show the pearlitic matrix and therein distributed spheroidal graphite structure of samples M10 and M15, respectively.

Then, for the grain refinement, specimens of 12 × 12 × 75 mm size machined from each sample ingot graphitizing annealed as mentioned above, were heat treated as follows.

With samples M03 and M10, specimens were dipped and stirred in a molten aluminum bath, kept at the temperature of 820° C, for 25 seconds, and then air cooled, and this operation was repeated for about 10 times, cyclically.

For the first 5 to 6 cycles of this heat treatment, the lamellar pearlite structure was still retained in the matrix, but by repeating more than 6 to 7 cycles, these lamellar cementites in the pearlite were fractionated to fine grains.

Accordingly, by repeating 10 cycles, matrix of specimen could be brought to the grain refined structure with dispersion of fully fractionated and spheroidized cementite crystals.

Specimen M15 transformed to the martensitic structure by air cooling from the austenite temperature range, so that, for the grain refinement, this specimen was normalized by heating at 850° C for 2 hrs. followed by air cooling, and then tempered by heating at 700° C for 2 hrs. followed by air cooling.

The grain refined microstructures of these specimens are shown in FIGS. 5, 6 and 7. FIGS. 5 and 6 show the structures of specimens M03 and M10, respectively, and are composed of very fine grained cementite particles dispersed in the ferrite matrix, on the other hand, FIG. 7 shows the structure of specimen M15 and the hemp leaf-like pearlite structure composed of the ferrite matrix with very fine cementite particles deposited therein by tempering the specimen of martensitic structure formed by air cooling from the austenite temperature range, at the eutectoid temperature range. Comparing FIGS. 5, 6 and 7 to FIGS. 2, 3 and 4, respectively, it will be apparent that the matrix structure is changed to the grain refined structure with the very fine cementite particles distributed in the ferrite matrix.

The results of tensile test at room temperature are listed in Table 3.

Table 3

| | Sample | Tensile Strength, Kg/mm² | Elongation, % |
|---|---|---|---|
| MO3 | Standard Structure | 49.0 | 14.0 |
| | Grain Refined Structure | 76.0 | 9.0 |
| M10 | Standard Structure | 68.5 | 4.9 |
| | Grain Refined Structure | 87.0 | 5.7 |
| M15 | Standard Structure | 54.5 | 4.8 |
| | Grain Refined Structure | 76.0 | 5.5 |

With specimens M10 and M15, which concern to this invention, samples of the grain refined structure show 27 to 39 percent higher tensile strength than that of the standard structure, and the elongation of the grain refined structure is also greater than that of the standard structure, so that the s.g. iron of the present invention has an excellent mechanical properties at room temperature.

Tensile test pieces were machined from these grain refined material, and the constant strain rate tensile test was performed by the Instron type tensile testing machine with the cross head speed ranging from 0.05 mm/min. to 5 mm/min. and at temperatures below, within and above the eutectoid temperature range.

The typical results of these tests are as follows.

FIGS. 8, 9 and 10 show the relation between the stationary flow stress $\sigma$ and the strain rate $d\epsilon/dt$ at various temperatures with the three different specimens respectively.

As shown in FIG. 8, specimen M03 with no additional manganese, shows small *m*-values of less than 0.3 at all temperatures and strain rates tested, whereas, as shown in FIG. 9, specimen M10 containing 0.9% manganese shows a high *m*-value of 0.42 at low strain rate and at the temperature of 748° C, which is within the eutectoid temperature range.

Also as shown in FIG. 10, specimen M15 containing 1.42% manganese shows a high *m*-value at any testing temperature under low strain rate, for example, m-value of 0.5 is shown at 748° C, which is within the austenite temperature range and about 50° C high above the eutectoid temperature range.

Relations between total elongation and testing temperature at each strain rate are shown in FIGS. 11 and 12, respectively, and in FIG. 12, results with the standard structure are also given for comparison.

Elongation of specimen M03 is small and less than 40% even with the grain refined structure, and regardless of testing temperature and strain rate.

On the other hand, elongation of specimen M10 shows a large value at 748° C, which is within the eutectoid temperature range, especially as shown in FIG. 11, attains to a maximum of 99% at low strain rate. Difference of elongation due to finess of structure is also observed at 700° C and 748° C in FIG. 12, and elongation of grain refined structure is extremely larger than that of standard structure. However, with specimen M10, elongation values of grain refined structure decrease and approach to those of standard structure at temperatures over 748° C.

With specimen M15, elongation is almost constant at temperatures below 700° C, which is within the eutectoid temperature range, and at each strain rate, but shows a rapid increase at 748° C, which is within the austenite temperature range, with the grain refined structure, and especially shows a large elongation at low strain rate test.

As shown in the above results, strain rate sensitivity factor *m*-value of comparing sample M03 is less than 0.3 and elongation is below 40% at any strain rate test, whereas, sample M10 of this invention shows large elongation of 85% in average and 99% at maximum within the eutectoid temperature range, and sample M15 of this invention shows large elongation at 748° C, which is about 50° C high above the eutectoid temperature range, though it does not show enough large elongation within that eutectoid temperature range.

The elongation behavior of each specimen at high temperature may be explained from its microstructure as follows.

FIGS. 13, 14 and 15 show the microstructures near the fractures of the tested specimens.

FIG. 13 is the structure of specimen M03 tested at 700° C, which is below the eutectoid temperature range and showed the elongation of 39%. In the figure, proceeding of ferritization of the matrix may be observed.

FIG. 14 is the structure of specimen M10 tested at 748° C in the eutectoid temperature range, and showed the maximum elongation of 99%, and in the figure, local grain growth due to long time tensile test is observed. However, it is assumed that the matrix is composed of fine austenite and fine ferrite grains at the testing temperature, because the grains which appear as austenite by solution of fine cementite particles in the ferrite on heating, have a size of several microns. Besides, in the figure, conical shaped voids are observed on either side of the spheroidal graphites in a direction 45° to the tensile direction, so these voids may be the cause of the fracture. Therefore, s.g. iron will not show such a large elongation of several hundreds percent as obtainable with the superplastic material of non-ferrous alloy or carbon steels.

Figure 11:
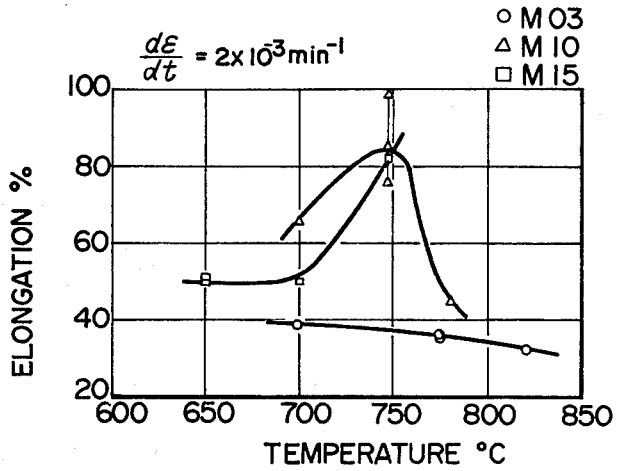
Figure 12:
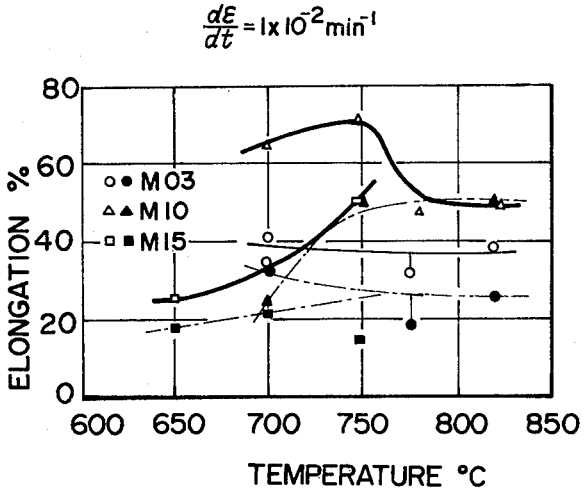

FIG. 15 is the structure of specimen M15 which showed 81% elongation at the temperature of 748° C. This temperature is within the austenite range of M15, but the solution of cementite has been retarded because of the containing of the sufficient amount of manganese, which is carbide stabilizer, so that the austenitization of matrix has not been completed in spite of the long time testing, and it will be clear that the matrix structure at the testing temperature is composed of the ferrite, austenite and cementite. Namely, the superplasticity of specimens M10 and M15 at the testing temperature may be due to the mixed structure of the fine ferrite and austenite grains, and these structure may be caused from the fine granular pearlite structure at the room temperature. In case of M15, which has a finely mixed structure even at the austenite range temperature, elongation increases with the increase of temperature as shown in FIGS. 11 and 12, because hard cementite particles decompose very gradually with the temperature increase. On the contrary, specimen M03 does not show superplasticity by the reason that the ferritization proceeds in the matrix containing fine cementite particles, and at the higher temperature grain growth occurs by the decomposition of cementite, so that the finely mixed structure of austenite and ferrite can not be obtained.

Figure 1:
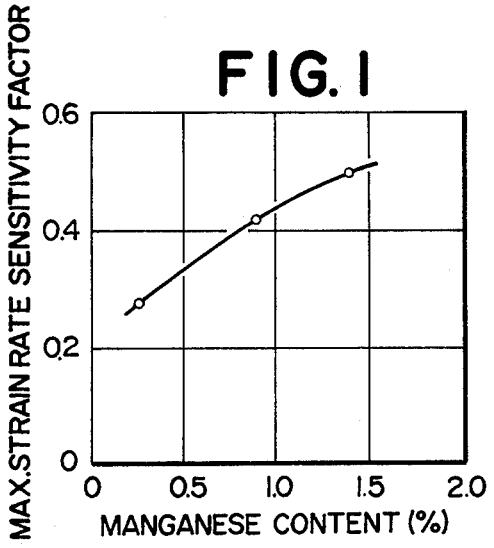
Figure 8:
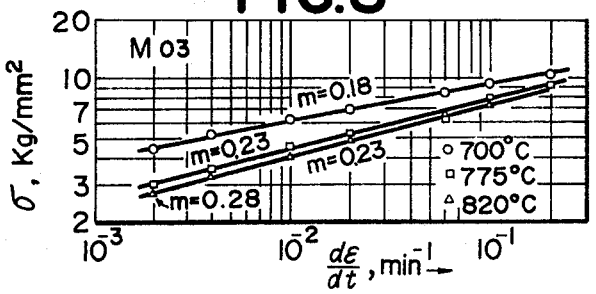
Figure 9:
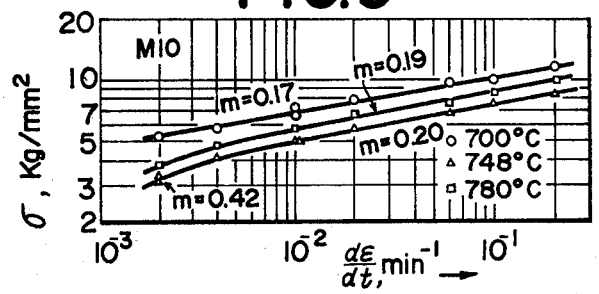
Figure 10:
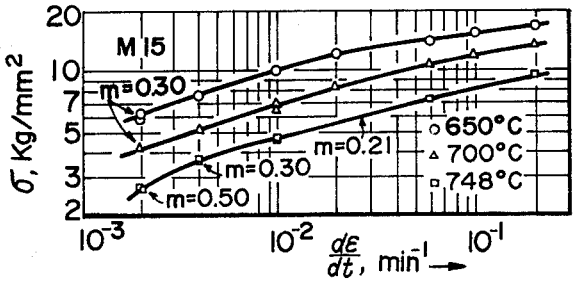

By the way, tensile test of specimen M15 at temperature above 748° C was not performed, but the increase of elongation at these temperatures may not be expected because of the difficulty of holding such finely mixed structure. The s.g. iron of the present invention has high elongation even though it has high tensile strength in comparison with conventional s.g.iron, because it has fine pearlitic matrix with very fine cementite particles dispersed in the ferrite grains, at room temperature. However, in general, materials having high elongation at room temperature do not always have superplastic property, and there is essentially no relation between both characteristics. The s.g. iron of this invention has to contain carbide stabilizing elements such as manganese and molybdenum to provide 0.3 or more of maximum strain rate sensitivity factor. For example, it can be seen from the graph of FIG. 1 that in order to obtain 0.3 or more of this factor with manganese, at least 0.4% of manganese content is required, and that the maximum strain rate sensitivity factor increases according to increasing of manganese content. On the other hand, the elongation decreases according to increasing of manganese content.

For the purpose of high elongation, low manganese content is preferred. When manganese content is increased, the elongation tensile strength is lowered resulting in lessened toughness, as observed with reference to samples M10 and M15 in FIGS. 11 and 12.

While the s.g iron herein described, and the methods of heat treatment for obtaining such s.g. iron, constitute preferred embodiments of the invention, it is to be understood that the invention is not limited to these particular features and methods, and that changes may be made in either without departing from the scope of the invention.

What is claimed is:

1. A ductile cast iron; having a structure comprising a grain refined matrix and the spheroidal graphites, said matrix being composed substantially of ferrite and fine cementite particles in said ferrite room temperature and composed substantially of fine austenite and fine ferrite grains at the temperature ranging from eutectoid temperature to about 50° C above the eutectoid temperature, and containing enough amount of at least one of carbide stabilizing elements to obtain maximum strain rate sensitivity factor of more than 0.3 on the deformation at the temperature ranging from the eutectoid temperature to about 50° C high above that eutectoid temperature.

2. The ductile cast iron of claim 1, in which said structure of matrix being composed of ferrite and very fine grained cementite particles dispersed in said ferrite at room temperature.

3. The ductile cast iron of claim 1, in which said structure of matrix being hemp leaf-like pearlite structure composed of ferrite with very fine cementite particles deposited therein at room temperature.

4. The ductile cast iron of claim 1, in which said carbide stabilizing elements include manganese and molybdenum.

5. The ductile cast iron of claim 1, in which is contained 0.4 – 1.5% manganese as the carbide stabilizing element.

6. A ductile cast iron which has a tensile strength of more than 75 $Kg/mm^2$ and elongation of more than 5% due to its grain refined matrix structure substantially composed of ferrite and fine cementite particles distributed therein, said ductile cast iron has a common chemical composition as that of ordinary ductile cast iron, but with some cementite stabilizing element to obtain a maximum strain rate sensitivity factor of more than 0.3 on the deformation at the temperature ranging from eutectoid temperature range to about 50° C high above that eutectoid temperature range.

7. A method of heat treatment to obtain the ductile cast iron of claim 1, in case a martensitic structure is not formed in said matrix by air cooling from the austenite temperature range; comprising repeated cycles of rapid heating to the austenite temperature range followed by air cooling.

8. A method of heat treatment to obtain the ductile cast iron of claim 1, in case a martensitic structure is formed in said matrix by air cooling from the austenite temperature range; comprising successive steps of (i) heating to said austenite temperature range followed by air cooling, and (ii) tempering at the eutectoid temperature range.

9. The ductile cast iron of claim 1, having a tensile strength of more than 75 $Kg/mm^2$ and elongation of more than 5% due to its very fine pearlite matrix.

* * * * *